US006160246A

United States Patent [19]

Rock et al.

[11] Patent Number: 6,160,246

[45] Date of Patent: Dec. 12, 2000

[54] METHOD OF FORMING ELECTRIC HEAT/WARMING FABRIC ARTICLES

[75] Inventors: Moshe Rock, Andover; Vikram Sharma, Stoneham, both of Mass.

[73] Assignee: Malden Mills Industries, Inc., Lawrence, Mass.

[21] Appl. No.: 09/395,326

[22] Filed: Sep. 13, 1999

Related U.S. Application Data

[62] Division of application No. 09/296,375, Apr. 22, 1999.

[51] Int. Cl.[7] ..... H05B 3/34

[52] U.S. Cl. ..... 219/545; 29/91.1; 219/529; 219/549

[58] Field of Search ..... 29/610.1, 611, 29/91, 91.1; 66/61, 80, 83, 169 R, 170, 171, 182, 190, 191, 192, 193, 194, 195, 202; 338/208; 219/211, 212, 213, 217, 527, 528, 529, 545, 549, 552

[56] References Cited

U.S. PATENT DOCUMENTS

| | | | |
|---|---|---|---|
| 975,359 | 11/1910 | Hefter | 219/549 |
| 1,553,461 | 9/1925 | Negromanti | 66/169 R |
| 1,744,327 | 1/1930 | Moore | 66/202 |
| 1,965,542 | 7/1934 | Colvin, Jr. | 66/202 |
| 2,025,586 | 12/1935 | Hall . | |
| 2,203,918 | 6/1940 | Moberg . | |
| 2,381,218 | 8/1945 | Jacob | 139/391 |
| 2,392,470 | 1/1946 | Fitzmaurice | 66/193 |
| 2,432,785 | 12/1947 | Moberg | 219/46 |
| 2,458,801 | 1/1949 | Schwartz | 66/190 |
| 2,670,620 | 3/1954 | Goldstaub | 66/195 |
| 2,862,097 | 11/1958 | Negromanti | 219/46 |
| 2,945,115 | 7/1960 | Weitzel | 66/171 |
| 3,425,020 | 1/1969 | Toyooka et al. | 338/208 |
| 3,478,422 | 11/1969 | Inui | 29/611 |
| 3,513,297 | 5/1970 | Jordan | 219/545 |
| 3,581,212 | 5/1971 | Spooner, Jr. et al. | 219/46 |
| 3,721,799 | 3/1973 | Carlstrom . | |
| 3,859,506 | 1/1975 | Weckstein . | |
| 4,021,640 | 5/1977 | Gross et al. | 219/211 |
| 4,063,069 | 12/1977 | Perri | 219/545 |
| 4,375,009 | 2/1983 | Fearnside et al. . | |
| 4,398,462 | 8/1983 | Okano . | |
| 4,481,881 | 11/1984 | Okano . | |
| 4,523,086 | 6/1985 | Eilentropp . | |
| 4,533,821 | 8/1985 | Sato . | |
| 4,564,745 | 1/1986 | Deschenes | 219/213 |
| 4,577,094 | 3/1986 | Mills . | |
| 4,607,154 | 8/1986 | Mills . | |
| 4,656,334 | 4/1987 | Endo et al. . | |
| 4,713,531 | 12/1987 | Fennekels et al. | 219/545 |
| 4,736,088 | 4/1988 | Bart | 219/211 |
| 4,792,662 | 12/1988 | Kitagaki et al. . | |
| 4,983,814 | 1/1991 | Ohgushi et al. | 219/545 |
| 5,073,688 | 12/1991 | McCormack . | |
| 5,081,341 | 1/1992 | Rowe | 219/212 |

(List continued on next page.)

*Primary Examiner*—Teresa Walberg
*Assistant Examiner*—Fadi H. Dahbour
*Attorney, Agent, or Firm*—Fish & Richardson P.C.

[57] ABSTRACT

A fabric article that generates heat upon application of electrical power is formed, for example, by joining stitch and loop yarns to form a fabric prebody, with the loop yarn forming in loops that overlay the stitch yarn at the technical face form the technical and back of the fabric prebody. An electrical resistance heating element in the form of a conductive yarn is incorporated into the fabric prebody at symmetrical and/or asymmetrical spaced-apart intervals e.g., as the stitch yarn, the electrical resistance heating elements extending between opposite edge regions of the fabric. The technical face and/or the technical back of the fabric body is finished, in a manner avoiding damage to electrical conductivity of the electrical resistance heating elements, to form a fleece surface region, and conductive elements are provided for connecting the electrical resistance heating elements to a source of electrical power. Preferably, the conductive yarn has a core of insulating material, an electrical resistance heating element about the core, and a sheath material surrounding the electrical resistance heating element and core.

12 Claims, 7 Drawing Sheets

U.S. PATENT DOCUMENTS 5,298,722 3/1994 Tanaka .
5,319,950 6/1994 Whitt et al. ..... 66/182
5,321,960 6/1994 Whitt et al. ..... 66/182
5,412,181 5/1995 Giamati .
5,422,462 6/1995 Kishimoto ..... 219/545
5,484,983 1/1996 Roell ..... 219/545
5,573,687 11/1996 Tanaka ..... 219/213
5,582,757 12/1996 Kio et al. .
5,918,319 7/1999 Baxter ..... 66/170

METHOD OF FORMING ELECTRIC HEAT/WARMING FABRIC ARTICLES

The application is a division of U.S. application Ser. No. 09/296,375, filed Apr. 22, 1999, and now pending.

The invention relates to fabric articles which generate heat/warmth upon application of electricity.

BACKGROUND OF THE INVENTION

Fabric heating/warming articles are known, e.g., in the form of electric blankets, heating and warming pads and mats, heated garments, and the like. Typically, these heating/warming articles consist of a fabric body defining one or a series of envelopes or tubular passageways into which electrical resistance heating wires or elements have been inserted. In some instances, the electric resistance heating wires are integrally incorporated into the fabric body during its formation, e.g. by weaving or knitting. Relatively flexible electric resistance heating wires or elements, e.g. in the form of a core of insulating material, e.g. yarn, about which is disposed an electrical conductive element, e.g. a helically wrapped metal wire or an extruded sheath of one or more layers of conductive plastic, have been incorporated directly into the woven or knitted structure of a fabric body.

SUMMARY OF THE INVENTION

According to one aspect of the invention, a method of forming a fabric article adapted to generate heat upon application of electrical power comprises the steps of: joining, by a reverse plaiting circular knitting process, a stitch yarn and a loop yarn to form a fabric prebody, the stitch yarn forming a technical face of the fabric prebody and the loop yarn forming a technical back of the fabric prebody, the loop yarn forming in loops that overlay the stitch yarn at the technical face and the technical back of the fabric prebody, at spaced-apart intervals, incorporating into the fabric prebody as the stitch yarn an electrical resistance heating element in the form of a conductive yarn, forming the fabric prebody into a fabric body, with the electrical resistance heating elements extending between opposite edge regions of the fabric body, finishing at least one of the technical face and the technical back of the fabric body, in a manner avoiding damage to electrical conductivity of the electrical resistance heating elements, to form a fleece surface region, and providing conductive elements for connecting the electrical resistance heating elements to a source of electrical power.

Preferred embodiments of this aspect of the invention may include one or more the following additional steps: finishing the technical face of the fabric body, in a manner to avoid damage to electrical conductivity of the electrical resistance heating elements, to form a first fleece surface region, and finishing the technical back of the fabric body in a manner to avoid damage to electrical conductivity of the electrical resistance heating elements to form a second fleece surface region; incorporating into the fabric body conductive yarn comprising a core of insulating material, an electrical resistance heating filament disposed generally about the core, and a sheath material generally surrounding the electrical resistance heating element and the core; preferably, forming the sheath material by wrapping the electrical resistance heating element and the core with yarn; connecting the conductive element to a source of electric power and generating heat, the source of electric power comprising alternating current or direct current, e.g. in the form of a battery, which may be mounted to the fabric article; limiting formation of loops to a central region of the fabric prebody, the central region being spaced from edge regions in the fabric body, and providing the conductive elements for connecting the electrical resistance heating elements to a source of electrical power in the edge regions of the fabric body; and/or rendering the yarns of the fabric body hydrophilic or hydrophobic.

According to another aspect of the invention, a fabric article adapted to generate heat upon application of electrical power comprises a fabric body, incorporated into the fabric body, in the form of conductive yarn, a plurality of spaced apart electrical resistance heating elements extending generally between opposite edge regions of the fabric body, and electrical conductor elements extending generally along the opposite edge regions of the fabric body and adapted to connect the plurality of spaced apart electrical resistance heating elements to a source of electrical power.

Preferred embodiments of this aspect of the invention may include one or more the following additional features. The electrical conductor elements are adapted for connecting the plurality of spaced-apart electrical resistance heating elements to a power source of alternating current or to a power source of direct current, e.g. a battery, which may be mounted to the fabric body. A series of at least three of the plurality of electrical resistance heating elements are symmetrically spaced and/or a series of at least three of the plurality of electrical resistance heating elements are asymmetrically spaced. The fabric body comprises a knitted body, e.g. a reverse plaited circular knitted, or other circular knitted (such as double knitted, single jersey knitted, two-end fleece knitted, three-end fleece knitted, terry knitted or double loop knitted), warp knitted or weft knitted body, or a woven body. The fabric body comprises hydrophilic or hydrophobic material. The fabric body has a technical face formed by a stitch yarn and a technical back formed by a loop yarn. The loop yarn forms loops that overlay the stitch yarn at the technical face and the technical back of the fabric prebody. The fabric prebody has loops formed only in a center region. The fabric body has fleece formed upon at least one, and preferably both, of the technical back and the technical face. The conductive yarn is a stitch yarn. The electrical conductor elements, at least in part, are applied as a conductive paste. Preferably, the electrical conductor elements comprise a conductive wire. The conductive yarn preferably comprises a core of insulating material, an electrical resistance heating filament disposed generally about the core, and a sheath material generally surrounding the electrical resistance heating filament and the core. Preferably, the core comprises a yarn of synthetic material, e.g. polyester. The sheath material comprises yarn, e.g. of a synthetic material, such as polyester, wrapped about the electrical resistance heating filament and the core. The electrical resistance heating filament comprises at least one metal filament, and preferably at least three metal filaments, wrapped helically about the core. The metal filament of the electrical resistance heating filament is formed of stainless steel. The electrical resistance heating element has electrical resistance in the range of about 0.1 ohm/cm to about 500 ohm/cm. In alternative embodiments of the conductive yarn, the core or the sheath material may be omitted.

An objective of the invention is to provide electric heating/warming fabric articles, e.g. electric blankets, heating and warming pads, heated garments, etc., into which a plurality of spaced-apart electric resistance heating members, in the form of conductive yarns, are incorporated by a knitting or weaving process. The fabric body of the heating/warming article, including the incorporated electric resistance heating members, may subsequently be subjected to a fabric finishing process, e.g., one or both surfaces of the fabric body may be napped, brushed, sanded, etc., to form fleece. In a planar structure, such as an electric heating blanket, the electric resistance heating members are connected at their ends along opposite edge regions of the planar fabric body, i.e. of the blanket, and may be powered by alternating current or direct current, including by one or more batteries mounted to the blanket.

Other features and advantages will be apparent from the following description of a presently preferred embodiment, and from the claims.

BRIEF DESCRIPTION OF THE DRAWINGS

FIG. 12 is a somewhat diagrammatic end section view of a preferred embodiment of a conductive yarn for an electric heating/warming fabric article of the invention, while

DESCRIPTION OF THE PREFERRED EMBODIMENTS

Figure 1:
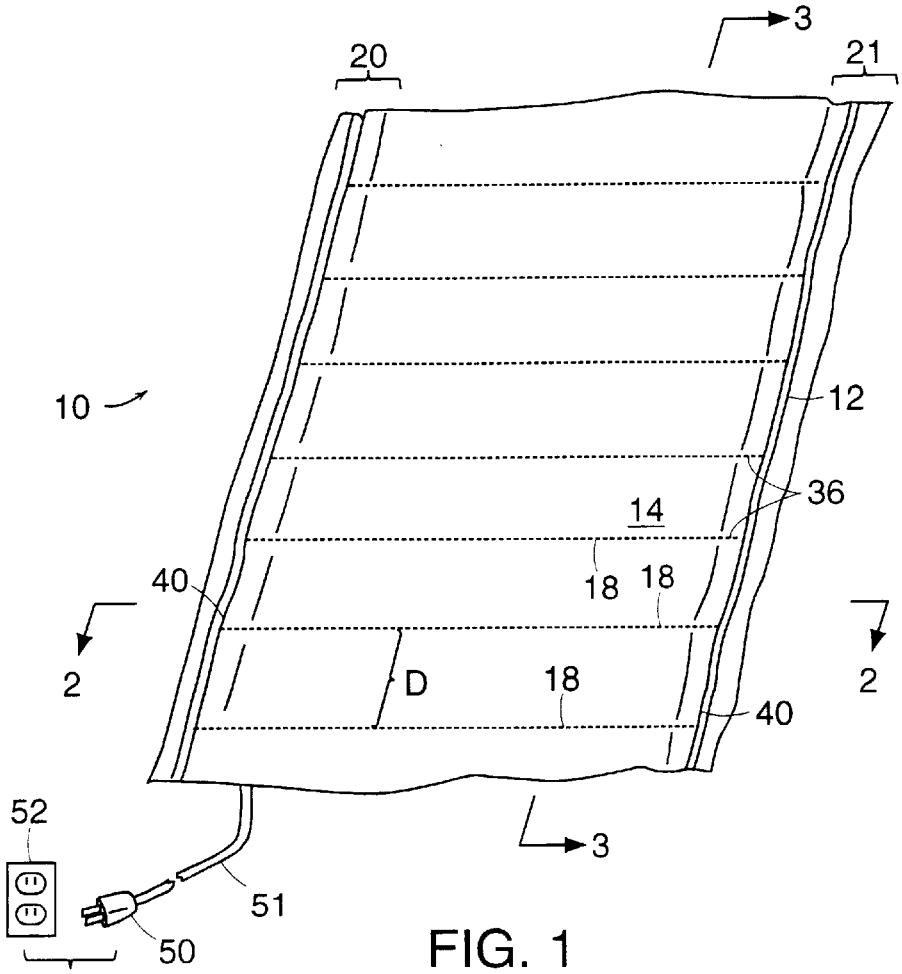
FIG. 1 is a perspective view of an electric heating/warming composite fabric article of the invention in the form of an electric blanket.

Referring to FIG. 1, an electric heating/warming composite fabric article of the invention, e.g. an electric blanket 10, adapted to generate heat upon application of electrical power, consists of a fabric body 12 having a technical back 14 and a technical face 16. The fabric body 12 incorporates a plurality of spaced-apart electric resistance heating elements 18 extending between opposite edge regions 20, 21 of the fabric body.

Figure 2:
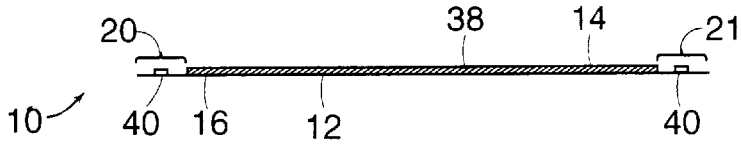
FIG. 2 is an end section view of the electric heating/warming composite fabric article of FIG. 1, taken at the line 2—2.
Figure 3:
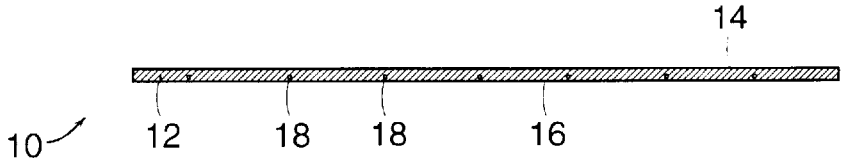
FIG. 3 is a side section view of the electric heating/warming composite fabric article of FIG. 1, taken at the line 3—3.
Figure 4:
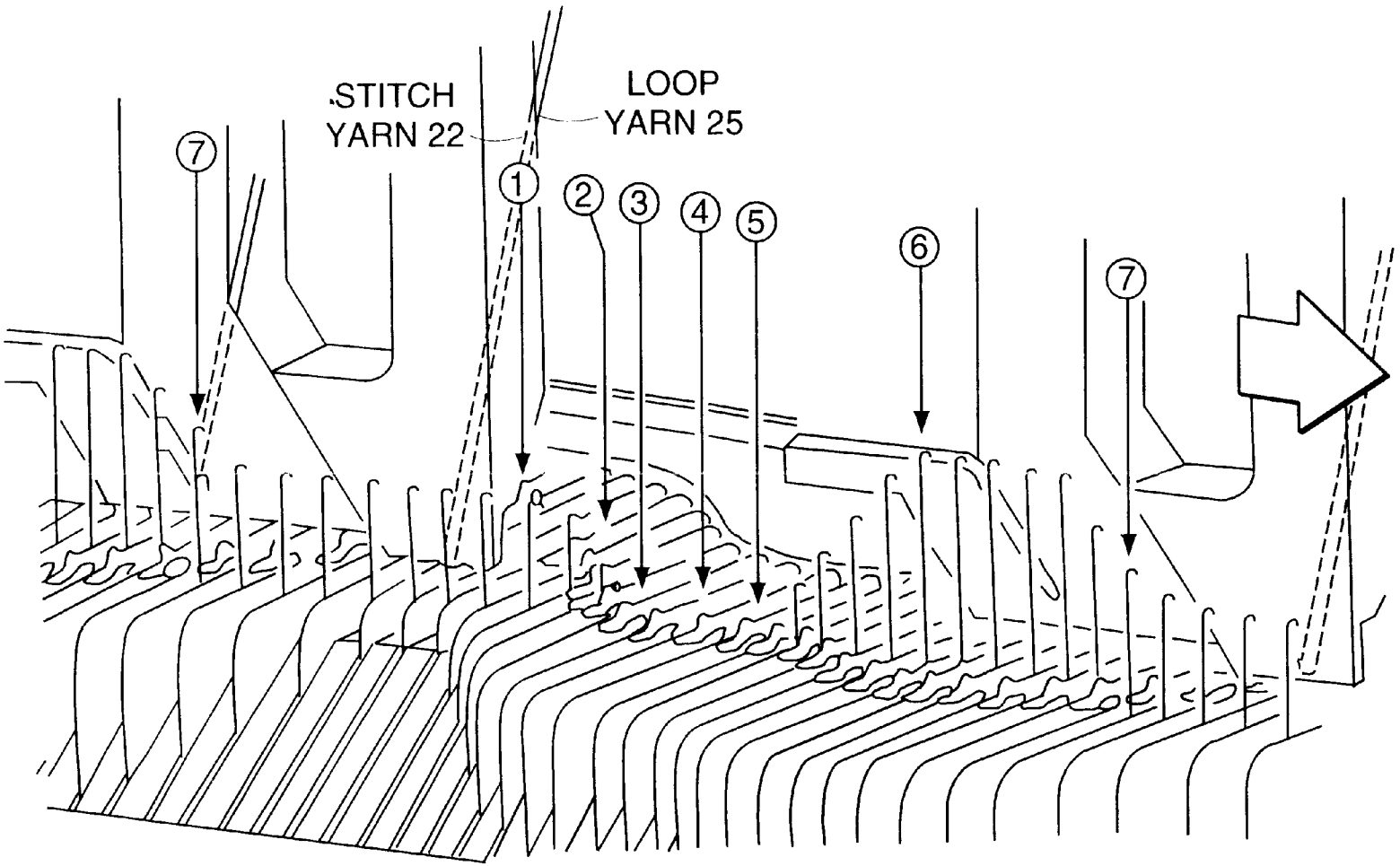
FIG. 4 is a perspective view of a segment of a circular knitting machine.
Figure 5:
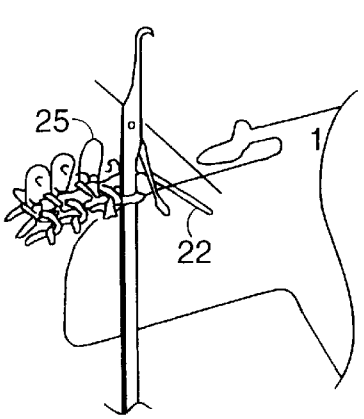
FIGS. 5–11 are sequential views of a cylinder latch needle in a reverse plaiting circular knitting process, e.g. for use in forming an electric heating/warming composite fabric article of the invention.
Figure 6:
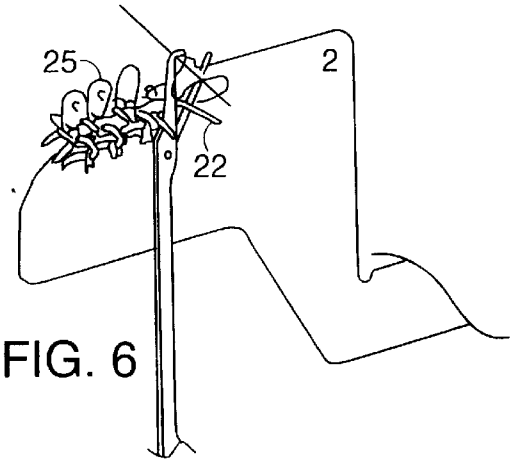
Figure 7:
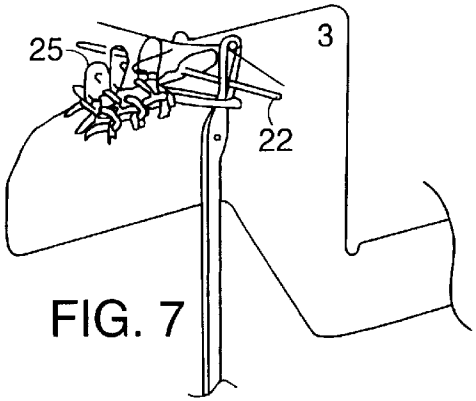
Figure 8:
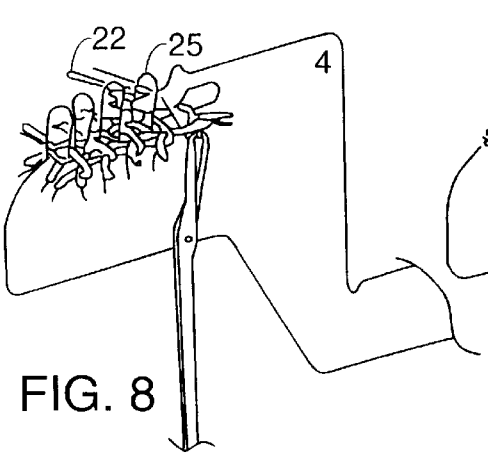
Figure 9:
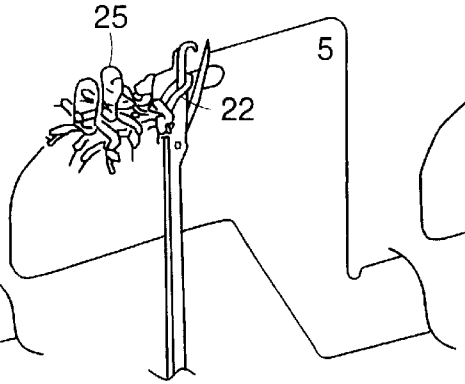
Figure 10:
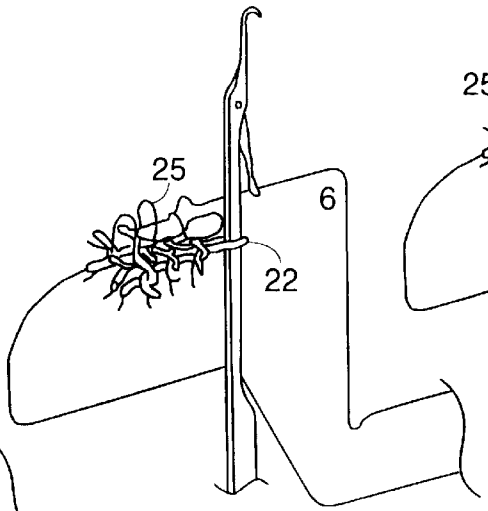
Figure 11:
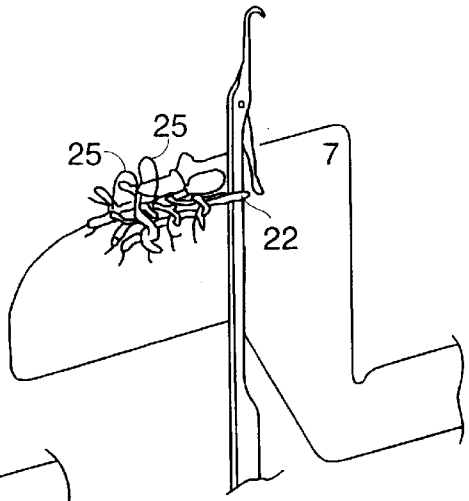
Figure 13:
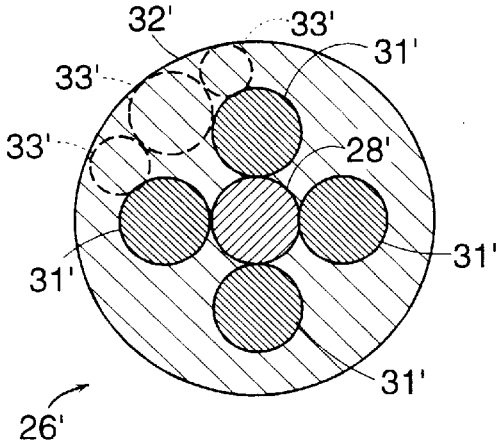
FIGS. 13–16 are similar views of alternative embodiments of conductive yarns for electric heating/warming fabric articles of the invention.

Referring also to FIGS. 4–11, in a preferred embodiment, the fabric body 12 is formed by joining a stitch yarn 22 and a loop yarn 25 in a standard reverse plaiting circular knitting (terry knitting) process, e.g. as described in *Knitting Technology*, by David J. Spencer (Woodhead Publishing Limited, 2nd edition, 1996), the entire disclosure of which is incorporated herein by reference. Referring again to FIGS. 2 and 3, in the terry knitting process, the stitch yarn 22 forms the technical face 16 of the resulting fabric body and the loop yarn 25 forms the opposite technical back 14, where it is formed into loops (25, FIG. 10) extending over the stitch yarn 22. In the fabric body 12 formed by reverse plaiting circular knitting, the loop yarn 25 extends outwardly from the planes of both surfaces and, on the technical face 16, the loop yarn 25 covers the stitch yarn 22 (e.g., see FIG. 17). As a result, during napping of the opposite fabric surfaces to form a fleece, the loop yarn 25 protects the stitch yarn 22, including the conductive yarns 26 knitted into the fabric body in the stitch yarn position.

The loop yarn 25 forming the technical back 14 of the knit fabric body 12 can be made of any synthetic or natural material. The cross section and luster of the fibers or the filament may be varied, e.g., as dictated by requirements of the intended end use. The loop yarn can be a spun yarn made by any available spinning technique, or a filament yarn made by extrusion. The loop yarn denier is typically between 40 denier to 300 denier. A preferred loop yarn is a 200/100 denier T-653 Type flat polyester filament, e.g. as available commercially from E.I. duPont de Nemours and Company, Inc., of Wilmington, Del.

The stitch yarn 22 forming the technical face 16 of the knit fabric body 12 can be also made of any type of synthetic or natural material in a spun yarn or a filament yarn. The denier is typically between 50 denier to 150 denier. A preferred yarn is a 70/34 denier filament textured polyester, e.g. as available commercially from UNIFI, Inc., of Greensboro, N.C.

Figure 12:
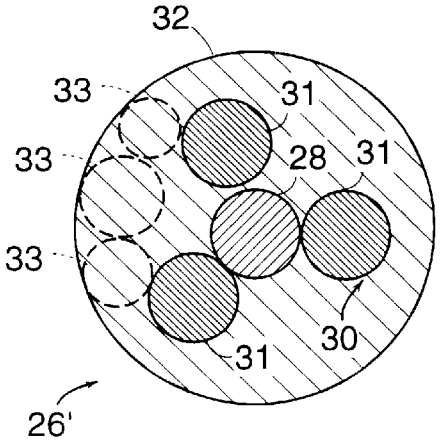

Referring now also to FIG. 12, and also to FIGS. 13–16, at spaced intervals during the knitting process, an electric resistance heating member 18 in the form of a conductive yarn 26 is incorporated into the fabric body 12 in place of the stitch yarn 22. Referring to FIG. 12, in a preferred embodiment, the conductive yarn 26 forming the electrical resistance heating elements 18 consists of a core 28 of insulating material, e.g. a polyester yarn, about which extends an electrical conductive element 30, e.g. three filaments 31 of stainless steel wire (e.g. 316L stainless steel) wrapped helically about the core 28, and an outer covering 32 of insulating material, e.g. polyester yarns 33 (only a few of which are suggested in the drawings) helically wrapped about the core 28 and the filaments 31 of the electrical conductive element 30. The conductive yarn 26 is available, e.g., from Bekaert Fibre Technologies, Bekaert Corporation, of Marietta, Ga., as yarn series VN14.

Figure 15:
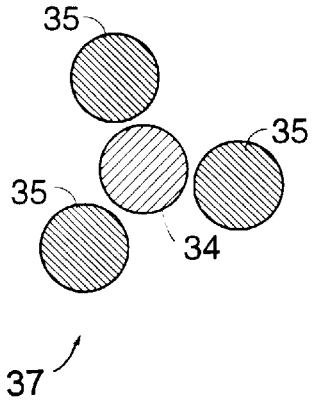
Figure 16:
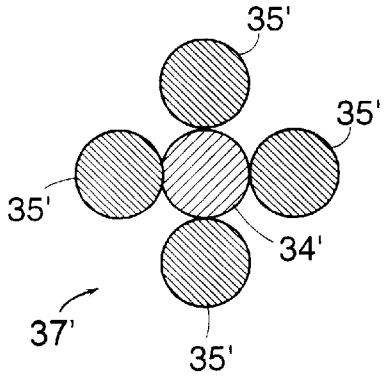
Figure 14:
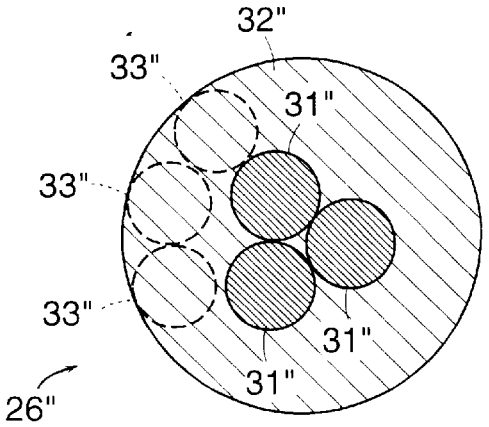

The number of conductive filaments in the conductive yarn, and where the filaments are located, are dependent, e.g., on the end use requirements. For example, in alternative configurations, in FIG. 13, conductive yarn 26' has four filaments 31' wrapped about core 28' with an outer covering 32' of polyester yarns 33'; in FIG. 14, conductive yarn 26" has three filaments 31" wrapped by outer covering 32" of polyester yarns 33", without a core. Referring to FIGS. 15 and 16, in other embodiments, conductive yarns 37, 37', respectively, are formed without an outer covering about the filaments 35, 35', respectively, wrapped about core 34, 34', respectively, the stitch yarn 22 and loop yarn 25 of the fabric body 12 instead serving to insulate the conductive yarns in the heating/warming fabric article. The resistance of the conductive yarn can be selected in the range, e.g., of from about 0.1 ohm/cm to about 500 ohm/cm on the basis of end use requirements of the heating/warming fabric article 10. However, conductive yarns performing outside this range can also be employed, where required. The core of the conductive yarn and the sheath material of the outer covering over the conductive filaments may be made of synthetic or natural material. The outer covering may also have the form of a sleeve, e.g. a dip-coated or extruded sleeve. Conductive yarns of different constructions suitable for use according to this invention can also be obtained from Bekaert Fibre Technologies.

In the preferred method of the invention, the fabric body 12 is formed by reverse plaiting on a circular knitting machine. This is principally a terry knit, where the loops is formed by the loop yarn 25 cover the stitch yarn 22 on the technical face 16 (see FIG. 17).

The conductive yarn is incorporated into the knit fabric prebody formed on the circular knitting machine at a specific spacing or distance apart, D (FIG. 1), for uniform heating in the resulting heating/warming fabric article 10. In a fabric prebody of the invention, the spacing is typically a function, e.g., of the requirements of heating, energy consumption and heat distribution in the article to be formed. For example, the spacing of conductive yarns may be in the range of from about 0.02 inch to about 2.5 inches. However, other spacing may be employed, depending on the conditions of intended or expected use, including the resistance of the conductive yarns. The conductive yarns may be spaced symmetrically from each other, or the conductive yarns may be spaced asymmetrically, with varying spacing, as desired. Also, in a fabric body of the invention, the power consumption for each conductive yarn is generally considerably lower than in the separate heating wires of prior art devices. As a result, the conductive yarns in a fabric body of the invention can be more closely spaced, with less susceptibility to hot spots.

The preferred position of the conductive yarn is in the stitch position of the circular knitted construction. The conductive yarn may then be knit symmetrically, i.e., at a specific distance apart, in each repeat, i.e., the conductive yarn can be in stitch position at any feed repeat of the circular knitting machine. Alternatively, the conductive yarns may be knit asymmetrically, with the yarns more closely or widely spaced, e.g., as desired or as appropriate to the intended product use. Again, the specific number of feeds, and the spacing of the conductive yarns, is dependent on the end use requirements.

Figure 17:
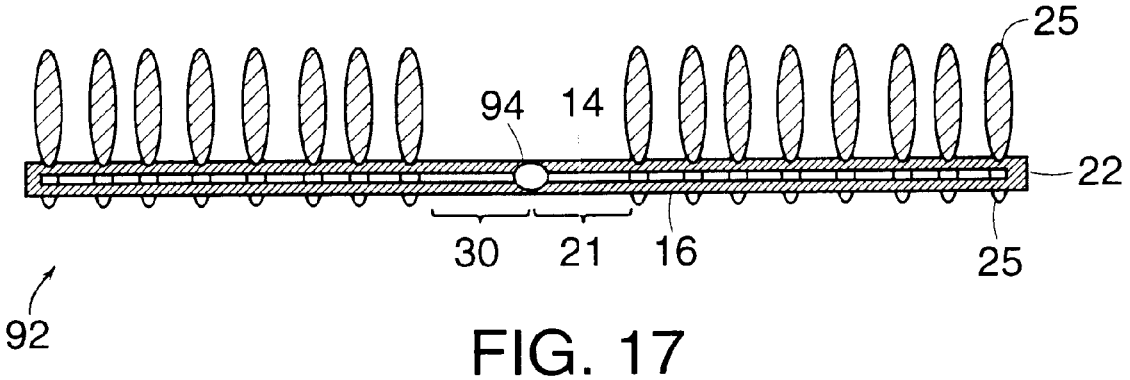
FIG. 17 is a somewhat diagrammatic section view of a segment of a tubular knit fabric during knitting.
Figure 18:
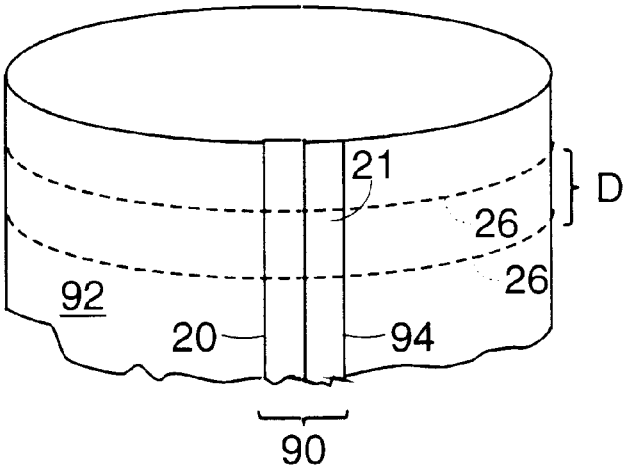
FIG. 18 is a somewhat diagrammatic perspective view of the tubular knit fabric of FIG. 17.

Referring to FIGS. 17 and 18, the end regions 20, 21 may be formed as a panel 90 in the tubular knit body 92. The edge regions 20, 21 of the fabric body are preferably formed without loops, and in a manner such that the edge regions do not curl upon themselves, e.g. the edge region panel is formed by single lacoste or double lacoste knitting. The ends portions 36 (FIG. 1) of the conductive yarns 26 extending into the flat regions 20, 21 without loops are thus more easily accessible in the end regions for completing an electrical heating circuit, as described below.

The tubular knit body 92 is removed from the knitting machine and slit, e.g. along a line of stitches 94 marking the desired slit line, to create a planar fabric. Alternatively, for increased accuracy, the tubular knit body 92 may be slit on line, e.g. by a cutting edge mounted to the knitting machine.

Preferably, the knitted fabric body 12 incorporating the electric resistance heating elements 18 in the form of the conductive yarns is next subjected to finishing. During the finishing process, the fabric body 12 may go through processes of sanding, brushing, napping, etc., to generate a fleece 38. The fleece 38 may be formed on one face of the fabric body 10 (FIG. 2), e.g., on the technical back 14, in the loop yarn, or a fleece 38, 38' may be formed on both faces of the fabric body 10' (FIG. 19), including on the technical face 16, in the overlaying loops of the loop yarn and/or in the stitch yarn. In either case, the process of generating the fleece on the face or faces of fabric body is preferably performed in a manner to avoid damage to the conductive yarn which is part of the construction of the fabric body 12. The fabric body may also be treated, e.g. chemically, to render the material hydrophobic or hydrophilic.

Figure 19:
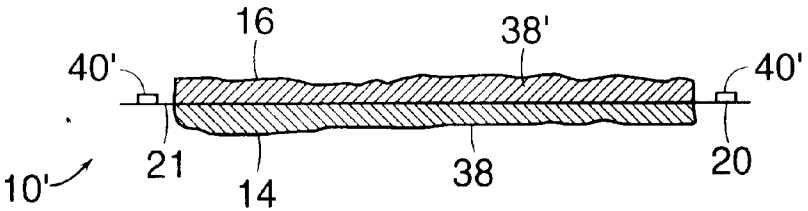
FIG. 19 is an end section view, similar to FIG. 2, of an electric heating/warming fabric article of the invention with fleece on both faces.
Figure 20:
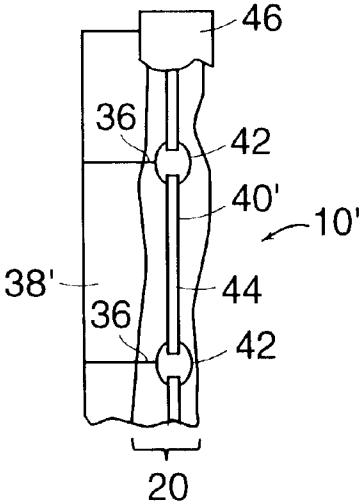
FIG. 20 is an enlarged, plan view of the technical face showing an alternative embodiment of a conductor element.

After finishing, and after the fabric body is heat set for width, the electric resistance heating elements are connected to a source of electrical power by conductors 40 in opposite edge regions 20, 21 (where, preferably, there are no loops on the surface), thereby to complete the electrical circuit. (The conductors or busses 40 may be formed on the technical back 14, as shown in FIG. 1, or they may instead be formed on the technical face 16, as seen in FIGS. 19 and 20.) Any suitable methods may be used to complete the circuit. For example, referring to FIG. 1, the conductor 40 may, at least in part, be applied in the form of a conductive paste, e.g. such as available commercially from Loctite Corporation, of Rocky Hill, Conn. The conductive paste may be applied as a stripe to a surface of the fabric body 10 in electrical conductive relationship with the electrical resistance heating elements 18, and then connected to the power source. (If necessary, the conductive yarns may be exposed, e.g., the polyester covering yarn may be removed with solvent or localized heat, e.g. by laser; the covering yarn may be manually unraveled; or the fabric body 10 may be formed with a needle out in the flat regions 20, 21, thus to facilitate accessibility to each of the conductive yarns.) Alternatively, referring to FIG. 20, the conductor 40' may consist of localized dots or regions 42 of conductive paste applied in electrical contact with exposed portions of the electric resistance heating elements 18, with a conductive metal wire 44 disposed in electrical conductive contact with, and extending, preferably continuously, between, the localized conductive paste regions 42. The electric conductor 40' is thereafter covered by a cloth trim or edging material 46, attached, e.g., by stitching along the edge of the fabric body 10'.

Figure 21:
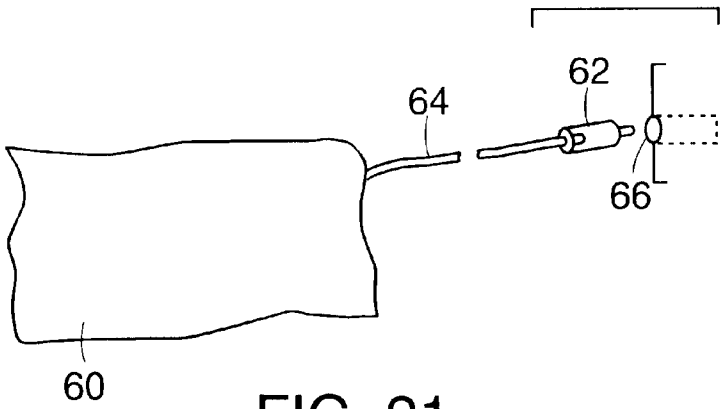
FIGS. 21, 22 and 23 are somewhat diagrammatic representations of other embodiments of heating/warming fabric articles of the invention, as adapted to be powered by direct current, e.g., an automobile warming or heating pad (FIG. 21), adapted to be powered from an automobile battery; and a stadium or camping blanket (FIG. 22) and a garment (FIG. 23), adapted to be powered from a battery replaceably mounted to the article.
Figure 23:
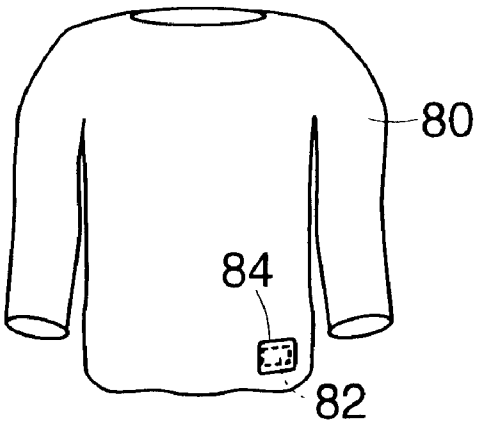
Figure 22:
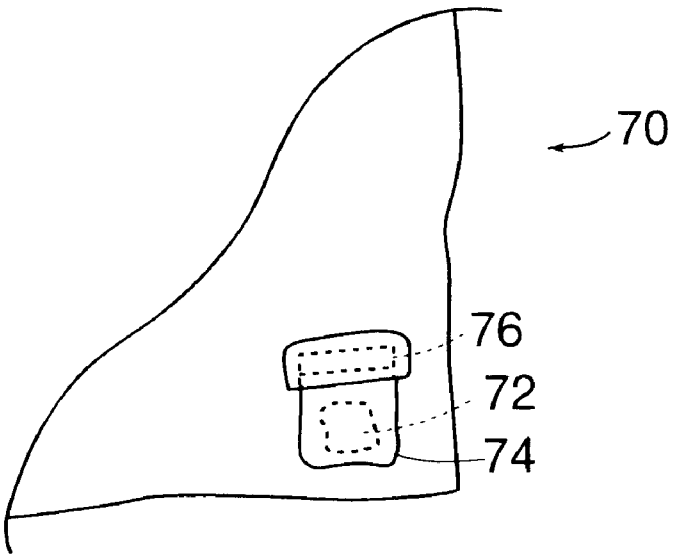

The completed circuit is next connected to a power source to supply electrical power to the electrical resistance heating elements for the required amount of heat generation. For example, referring to FIG. 1, an electric heating/warming fabric article 10 of the invention (an electric blanket) is adapted for connection to a source of alternating current by means of plug 50 on cord 51 for insertion in household outlet 52. Referring to FIG. 21, a warming or heating pad 60 of the invention, e.g. for an automobile seat, is adapted for connection to a source of direct current by means of plug 62 on cord 64 for insertion into the cigarette lighter or other power outlet 66 of an automobile. Referring to FIGS. 22 and 23, a stadium or camping blanket 70 and a garment 80 of the invention each includes a source of direct current, i.e. a battery pack 72, 82, respectively, e.g., as available from Polaroid Corporation, of Cambridge, Mass., replaceably mounted to the heating/warming fabric article, e.g. in a pocket 74, 84, respectively. Referring to FIG. 22, the pocket may be secured by a hook-and-loop type fastener 76. Preferably, for certification by Underwriters' Laboratory (UL®), the voltage supplied by the power source to the electrical resistance heating elements is lower than 25 volts, e.g. a Class II UL® certified transformer may be used to step down a 110v power supply to 25 volts or under.

Other embodiments are within the following claims. For example, any type of yarn may be employed. Also, other methods of constructing fabric heating/warming articles of the invention may be employed, e.g. the yarn may be incorporated by warp knit or weft knit construction or by woven construction.

What is claimed is:

1. A method of forming a fabric article adapted to generate heat upon application of electrical power, said method comprising the steps of:

joining, by a reverse plaiting circular knitting process, a stitch yarn and a loop yarn to form a fabric prebody, the stitch yarn forming a technical face of the fabric prebody and the loop yarn forming a technical back of the fabric prebody, the loop yarn forming in loops that overlay the stitch yarn at the technical face and at the technical back of the fabric prebody, at spaced-apart intervals, incorporating into the fabric prebody as the stitch yarn an electrical resistance heating element in the form of a conductive yarn, forming the fabric prebody into a fabric body, with the electrical resistance heating elements extending between opposite edge regions of the fabric body, in a manner to avoid damage to electrical conductivity of the electrical resistance heating elements, finishing at least one of said technical face and said technical back of the fabric body to form a fleece surface region, and providing conductive elements for connecting the electrical resistance heating elements, in parallel, to a source of electrical power.

2. The method of claim 1, further comprising the steps of: finishing the technical face of the fabric body, in a manner to avoid damage to electrical conductivity of the electrical resistance heating elements, to form a first fleece surface region, and finishing the technical back of the fabric body in a manner to avoid damage to electrical conductivity of the electrical resistance heating elements to form a second fleece surface region.

3. The method of claim 1, wherein the conductive yarn being incorporated into the fabric prebody comprises a core of insulating material, an electrical resistance heating filament disposed generally about said core, and a sheath material generally surrounding said electrical resistance heating element and said core.

4. The method of claim 3 further comprising the step of forming the sheath material by wrapping said electrical resistance heating element and said core with yarn.

5. The method of claim 1 further comprising the step of connecting the conductive element to a source of electric power and generating heat.

6. The method of claim 5 further comprising the step of connecting the conductive element to a source of electric power comprising alternating current and generating heat.

7. The method of claim 5 further comprising the step of connecting the conductive element to a source of electric power comprising direct current and generating heat.

8. The method of claim 7 further comprising the step of connecting the conductive element to a source of electric power comprising direct current in the form of a battery and generating heat.

9. The method of claim 8 further comprising the step of connecting the conductive element to a source of electric power comprising direct current in the form of a battery mounted to the fabric article and generating heat.

10. The method of claim 1 further comprising the steps of:

limiting formation of loops to a central region of the fabric prebody, the central region being spaced from edge regions in the fabric body, and providing the conductive elements for connecting the electrical resistance heating elements to a source of electrical power in the edge regions of the fabric body.

11. The method of claim 1 further comprising the step of rendering the yarns of said fabric body hydrophilic.

12. The method of claim 1 further comprising the step of rendering the yarns of said fabric body hydrophobic.

* * * * *

UNITED STATES PATENT AND TRADEMARK OFFICE

CERTIFICATE OF CORRECTION

PATENT NO. : 6,160,246
APPLICATION NO. : 09/395326
DATED : December 12, 2000
INVENTOR(S) : Moshe Rock and Vikram Sharma It is certified that error appears in the above-identified patent and that said Letters Patent is hereby corrected as shown below:

In the Abstract, line 5, after “face” insert --and--.

In the claims, column 8, line 9 “element” should be --filament--.

Signed and Sealed this

Twentieth Day of March, 2007

JON W. DUDAS
*Director of the United States Patent and Trademark Office*